United States Patent [19]

Parks et al.

[11] 4,355,610

[45] Oct. 26, 1982

[54] SERVO BOOSTED GOVERNOR CONTROL FOR ENGINES

[75] Inventors: John H. Parks; Charles E. Alstrin; Dennis M. King, all of Peoria, Ill.

[73] Assignee: Caterpillar Tractor Co., Peoria, Ill.

[21] Appl. No.: 211,531

[22] PCT Filed: Mar. 28, 1980

[86] PCT No.: PCT/US80/00338

§ 371 Date: Mar. 28, 1980

§ 102(e) Date: Mar. 28, 1980

[87] PCT Pub. No.: WO81/02763

PCT Pub. Date: Oct. 1, 1981

[51] Int. Cl.[3] ..... F02D 7/00

[52] U.S. Cl. ..... 123/386; 123/388

[58] Field of Search ..... 123/386, 385, 388, 379

[56] References Cited

U.S. PATENT DOCUMENTS

| | | | |
|---|---|---|---|
| 2,364,817 | 12/1944 | Reggio | 123/386 |
| 3,145,624 | 8/1964 | Parks et al. | 123/385 |
| 3,159,036 | 12/1964 | Miller et al. | 123/198 DB |
| 3,234,927 | 2/1966 | Cramer, Jr. | 123/385 |
| 3,499,426 | 3/1970 | Bailey | 123/385 |
| 3,640,258 | 2/1972 | Isobe et al. | 123/385 |
| 3,777,730 | 12/1973 | Gates et al. | 123/385 |
| 3,818,883 | 6/1974 | Glassey | 123/385 |
| 3,915,140 | 10/1975 | Parks et al. | 123/385 |
| 4,050,434 | 9/1977 | Zbikowski et al. | 123/385 |
| 4,120,275 | 10/1978 | Isobe et al. | 123/386 |

*Primary Examiner*—Ira S. Lazarus
*Assistant Examiner*—Magdalen Moy
*Attorney, Agent, or Firm*—Phillips, Moore, Weissenberger, Lempio & Majestic

[57] ABSTRACT

The pedal effort required to change the setting of a governor (13) of an engine increases sharply with increased engine speed. Booster controls have been provided in the art for applying a boost force ($F_B$), additive to an operator input force ($F_L$), for opposing the force ($F_S$) of a governor spring (42) to thus reduce pedal effort at high engine speeds. The improved booster control (15,15a) herein includes an actuating chamber (53,53a) and a control arrangement (51,51a) for controlling fluid pressure in the chamber (53,53a) when the setting of the governor (13) is changed by the operator and in a predetermined ratio to the operator's input force. The booster control (15,15a) has wider application wherein a boosting force ($F_B$) is desired to supplement an input force ($F_L$) for controlling movement of a member (23) having an opposing force ($F_S$) applied thereto.

26 Claims, 6 Drawing Figures

SERVO BOOSTED GOVERNOR CONTROL FOR ENGINES

DESCRIPTION

Technical Field

This invention relates to a servo booster governor (hereinafter called booster) control particularly adapted for automatically reducing throttle effort during operation of an internal combustion engine.

Background Art

Fuel injection systems of the type employed in diesel engines, typically run at rate speeds of from 650 to 2400 rpm, must be precisely designed to exhibit trouble-free operation over an extended period of time. Such systems include a throttle control, usually including an accelerator pedal, for increasing the power of the engine at the will of the operator. The accelerator pedal is connected through a suitable linkage to a governor control lever which functions to compress a spring and associated flyweights thus moving the governor to a higher setting. The governor spring controls actuation of another linkage, interconnecting the governor with the injection pumps of the engine, to closely control injection of fuel into the cylinders of the engine. Thus, depression of the accelerator pedal by the operator will provide him with the additional power he requires and, simultaneously, the governor will balance out at this higher setting.

One of the problems encountered with conventional fuel injection systems of this type is that when an engine is running at speeds above low idle, pedal effort increases with speed, requiring greater pedal effort by the operator to compress the governor spring to change the increased setting of the governor. This phenomenon is depicted in FIG. 6 of the drawings by the curve labeled "Standard Governor."

A solution to this problem comprises the utilization of a booster apparatus for applying an additional force to the governor spring, additive to the force applied to the spring by depression of the accelerator pedal by the operator, whereby the pedal effort is reduced. Such booster apparatus have included means for communicating air intake manifold pressure or engine lubricating oil to the governor to counteract the opposing force of the governor spring. To date, such booster apparatus have been found to be unduly complex and expensive to manufacture and do not always ensure the precise booster and governor control effort required. In addition, leakage and related problems may be occasioned to further affect the precise control of the system. Also, only one specific magnitude of boost force is normally designed into conventional systems.

DISCLOSURE OF THE INVENTION

The present invention is directed to overcoming one or more of the problems as set forth above.

In one aspect of this invention, a booster apparatus comprises a control member, first means for applying a first force to the control member to move it in a first direction, second means for applying a second force to the control member in opposition to the first force, and third means for applying a third force to the control member in opposition to the first force and additive to the second force to assist the second means in urging the control member in a second direction opposite to the first direction. An improvement in the booster apparatus comprises third means, including a reciprocal cylinder positioned to be subjected to the first, second, and third forces, control means for continuously maintaining a predetermined and at least substantially constant fluid pressure in the actuating chamber when the second means is moved to a predetermined position, and means for automatically deactivating the third means in response to the first means being in a selected speed range. Another improvement in the booster apparatus comprises vent means for opening to vent fluid pressure from the actuating chamber with the vent means being defined between the cylinder and a column on which the cylinder is reciprocally mounted.

In another aspect of this invention, the booster apparatus finds particular application to a fuel control system comprising fuel control means for controlling the supply of fuel to an engine, governor means ("first means") for automatically controlling supply of fuel to the engine by the fuel control means in response to the speed of the engine, operator input means ("second means") for selectively applying a first force to the governor means to oppose a counteracting force of the governor means, and booster means ("third means") for applying a second force to the governor means, additive to the first force, to aid the operator input means in opposing the force of the governor means.

In still another aspect of this invention, the booster means includes valve means for controlling the second force in a predetermined ratio to the first force.

The booster apparatus of this invention provides a non-complex and economical means for precisely controlling a booster assist to an operator of a vehicle upon his depression of an accelerator pedal. The operator is thus enabled to move the governor means to a higher setting to provide the additional power needed without requiring an unduly high pedal effort. The response from throttle to fuel change is with the governor adjusting to the higher setting, dictated by amount of depression of the accelerator pedal by the operator. Also, the booster apparatus may be designed to have its boost force selected from a range of boost forces to effect a desired ratio in respect to the input force of the operator.

BRIEF DESCRIPTION OF THE DRAWINGS

Other objects of this invention will become apparent from the following description and accompanying drawings wherein.

BEST MODE OF CARRYING OUT THE INVENTION

Figure 1:
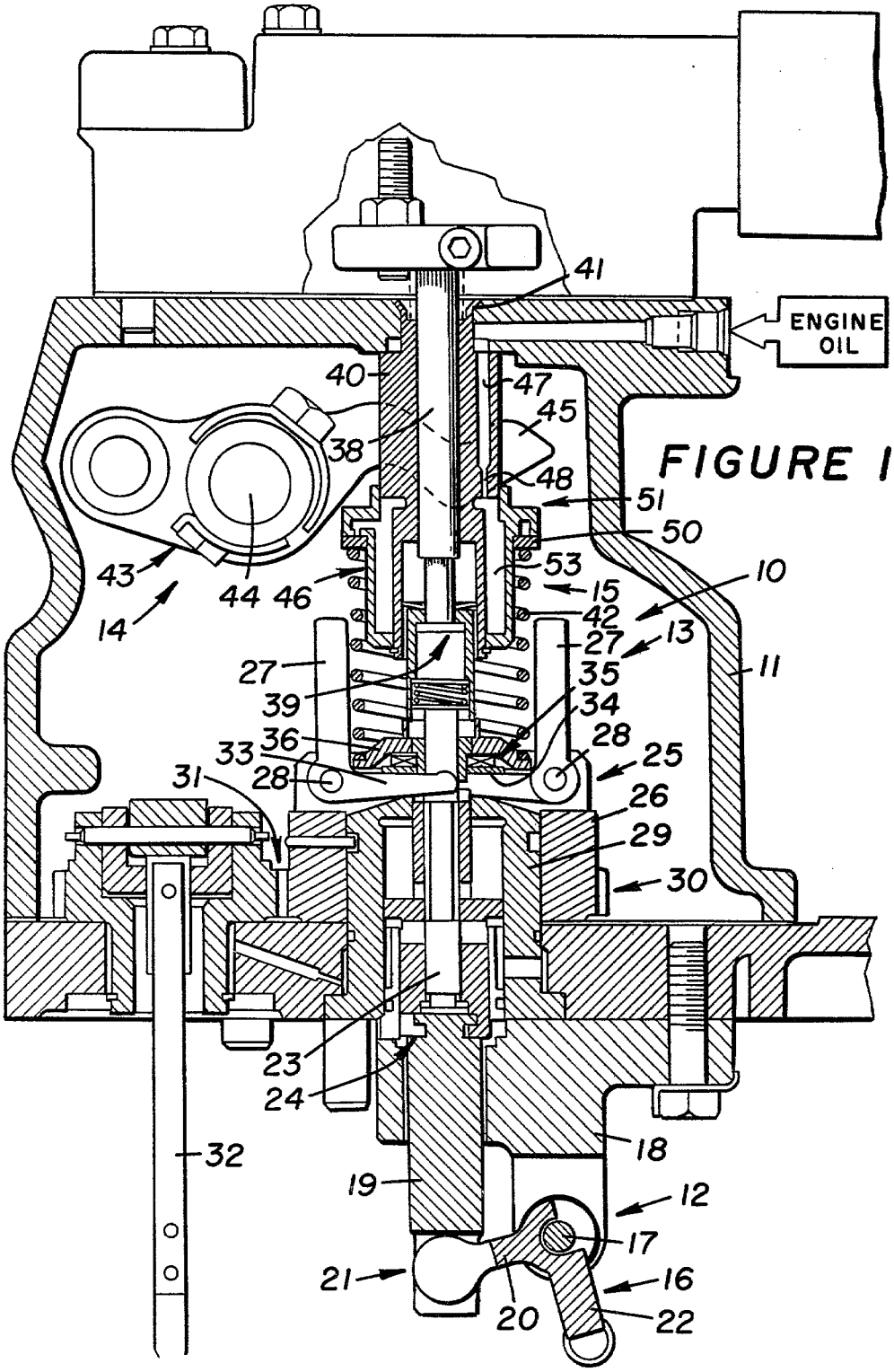
FIG. 1 is a sectional view through a fuel control system employing a first booster apparatus embodiment of the present invention therein, shown in a starting stage of operation.

FIG. 1 illustrates a fuel control system 10 mounted on a housing 11, secured in a conventional manner on an internal combustion engine. Fuel control system 10 essentially comprises a fuel control means 12 for controlling supply of fuel to the fuel injection nozzles of a diesel engine, governor means 13 for automatically controlling supply of such fuel in response to the speed of the engine, and operator input means 14 for selectively applying a first force to governor means 13 to override a counteracting force of the governor means. This invention relates to a booster means 15 for applying a second, downward force to governor means 13 which is additive to the first downward force applied thereto by operator input means 14, to aid the operator input means in opposing the force of governor means 13 to selectively give the governor means a higher setting.

Partially illustrated fuel control means 12 comprises a bellcrank 16, pivotally mounted by a pin 17 on a bracket 18 secured to housing 11, for pivoting in response to axial movements of an output shaft 19, slidably mounted in bracket 18. A first arm 20 of bellcrank 16 is pivotally connected at a ball and socket connection 21 to a lower end of shaft 19 whereas a second arm 22 of bellcrank 16 is suitably connected by a standard linkage (not shown) to a series of fuel injection pumps (not shown) of the engine to control the quantity of fuel injected into the combustion chambers thereof.

Figure 2:
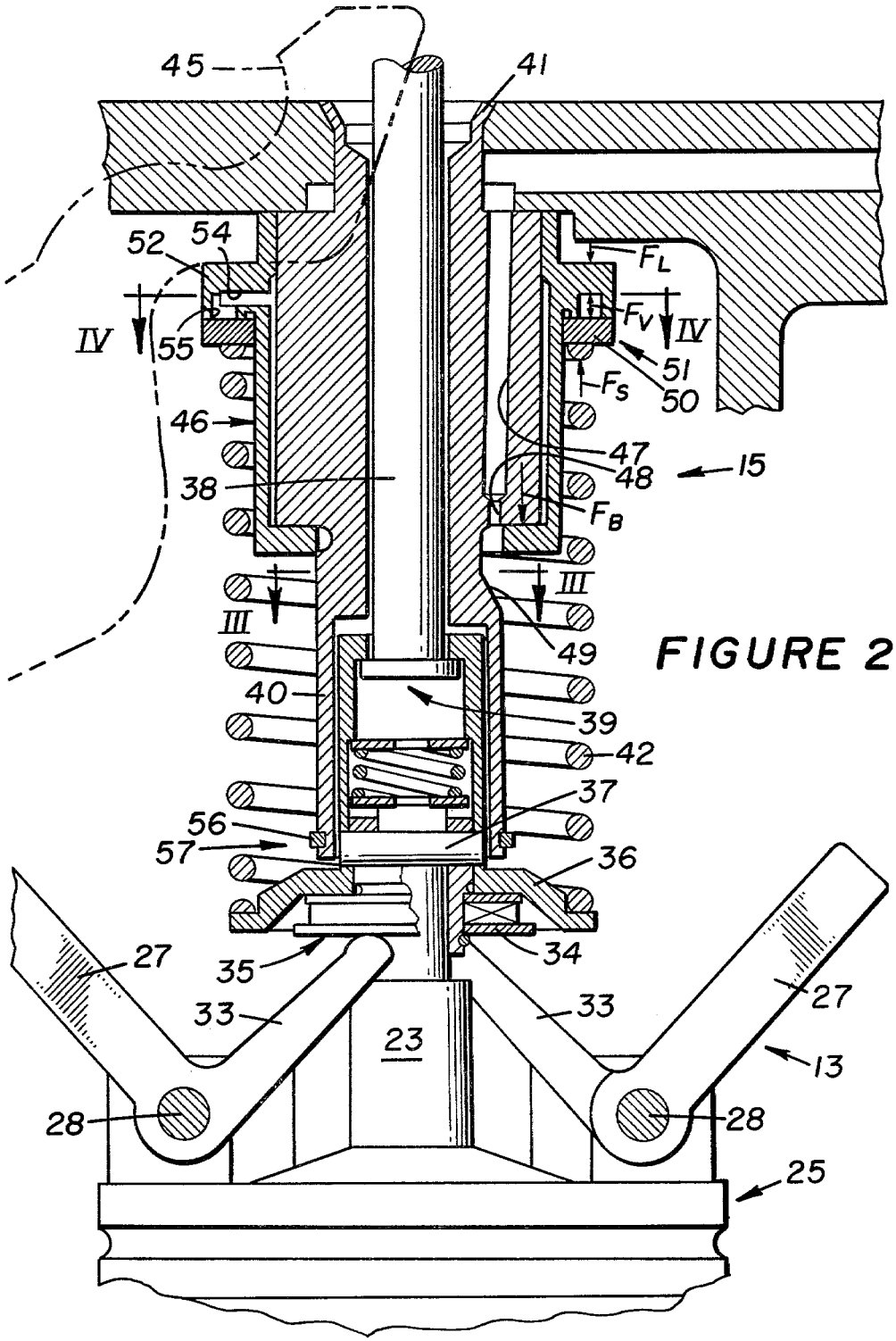
FIG. 2 is an enlarged sectional view of the booster apparatus generally taken in the direction of arrows II—II in FIG. 3, shown in a second stage of operation.

The upper end of output shaft 19 is connected to a reciprocal riser shaft 23 at a bayonet connection 24 to reciprocate simultaneously therewith. As shown in FIGS. 1 and 2, governor means 13 comprises a carrier 25, including an annular gear member 26. A pair of flyweights 27 are each pivotally mounted on carrier 25 by a pin 28 whereby upon rotation of carrier 25 about a fixed bearing 29 flyweights 27 will pivot radially outwardly.

A first gear 30 is formed on member 26 and meshes with a second gear 31. Gear 31 is suitably attached to an engine-driven input shaft 32 whereby rotation of gear 31 will, in turn, rotate gear 30 and carrier 25.

Referring to FIG. 2, rotation of carrier 25 to pivot flyweights 27 radially outwardly will engage an arm 33 of each of the flyweights with an annular race 34 of a thrust bearing assembly 35 which is mounted on riser shaft 23 to reciprocate therewith. A spring riser 36 is secured on riser shaft 23 by a cross pin 37 and has an upper end thereof mounted on an axial rod 38 at a flanged connection 39. Rod 38 is mounted within a stationary column 40 which may have its upper end suitably secured to housing 11 at a flared portion 41.

A selected or balanced standard governor spring 42, mounted between riser 36 and booster means 15, is adapted to be compressed in an upward direction upon radial outward pivoting of flyweights 27 and to be compressed in the opposite direction by the additive forces of operator control means 14 and booster means 15. In particular, operator control means 14 (FIG. 1) comprises a control lever 43 which is mounted on a pivotal shaft 44 to engage a pair of bifurcated arms 45 thereof with an upper end of a cylinder 46 which is reciprocally mounted on column 40. Shaft 44 is suitably connected to an operator-controlled accelerator pedal or the like (not shown) to selectively pivot control lever 43 clockwise in FIG. 2 to move cylinder 46 downwardly against the opposed biasing force of spring 42. A passage 47, having an orifice 48 defined at a lower end thereof, is formed in column 40 to communicate engine oil therethrough.

Figure 3:
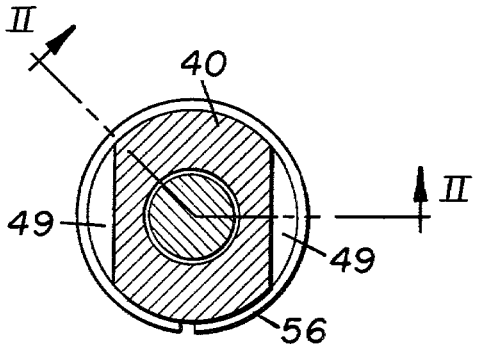

In the illustrated upward or open position of cylinder 46 in FIG. 2, upon startup of the associated engine, engine oil is free to dump into the confines of housing 11 and back to sump, via vent means comprising a pair of flat shoulders 49 formed on the otherwise cylindrical column 40 (FIG. 3). As further shown, governor spring 42 continuously biases an annular valve ring 50 of a valve means 51 against a seat defined on an underside of a flange 52 of cylinder 46.

Figure 4:
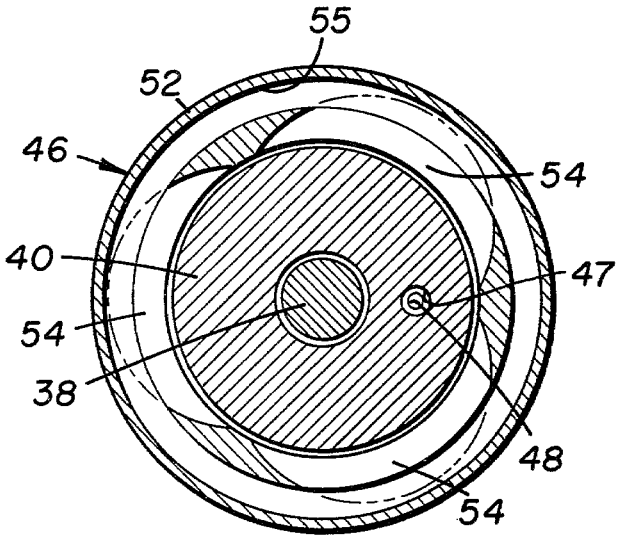
FIGS. 3 and 4 are cross-sectional views, taken in the direction of arrows III—III and IV—IV, respectively, in FIG. 2.

When cylinder 46 moves downwardly from its FIG. 2 towards its FIG. 1 position when urged by the operator through lever 45, the cylinder will cover shoulders 49 to define an actuating chamber 53 (FIG. 1) which receives pressurized oil from passage 47 and orifice 48. Such oil is communicated from chamber 53 to an upper side of valve ring 50 via three slots 54 and an annular groove 55 formed in flange 52 of piston 46, as shown in FIG. 4.

As described more fully hereinafter, orifice 48 and valve ring 50 comprise control means 51 for continuously controlling oil pressure in actuating chamber 53 in a predetermined ratio relative to the input force of the operator at lever 45. When the oil pressure in chamber 53 exceeds a predetermined level, valve ring 50 will unseat to permit dumping of oil therepast, via slots 54 and groove 55, until the oil pressure again falls to such predetermined level. As shown by the "Boosted Governor" curve in FIG. 6, when engine speed exceeds a speed of 1300 rpm, for example, the boost force provided by oil pressure in actuating chamber 53 which acts downwardly on cylinder 46 (FIG. 1) will increase relative to engine speed. As further shown in the shaded area on this curve, the boost force can be varied selectively within the depicted range by suitably varying the design parameters of valve means 51 and related constructions.

Figure 6:
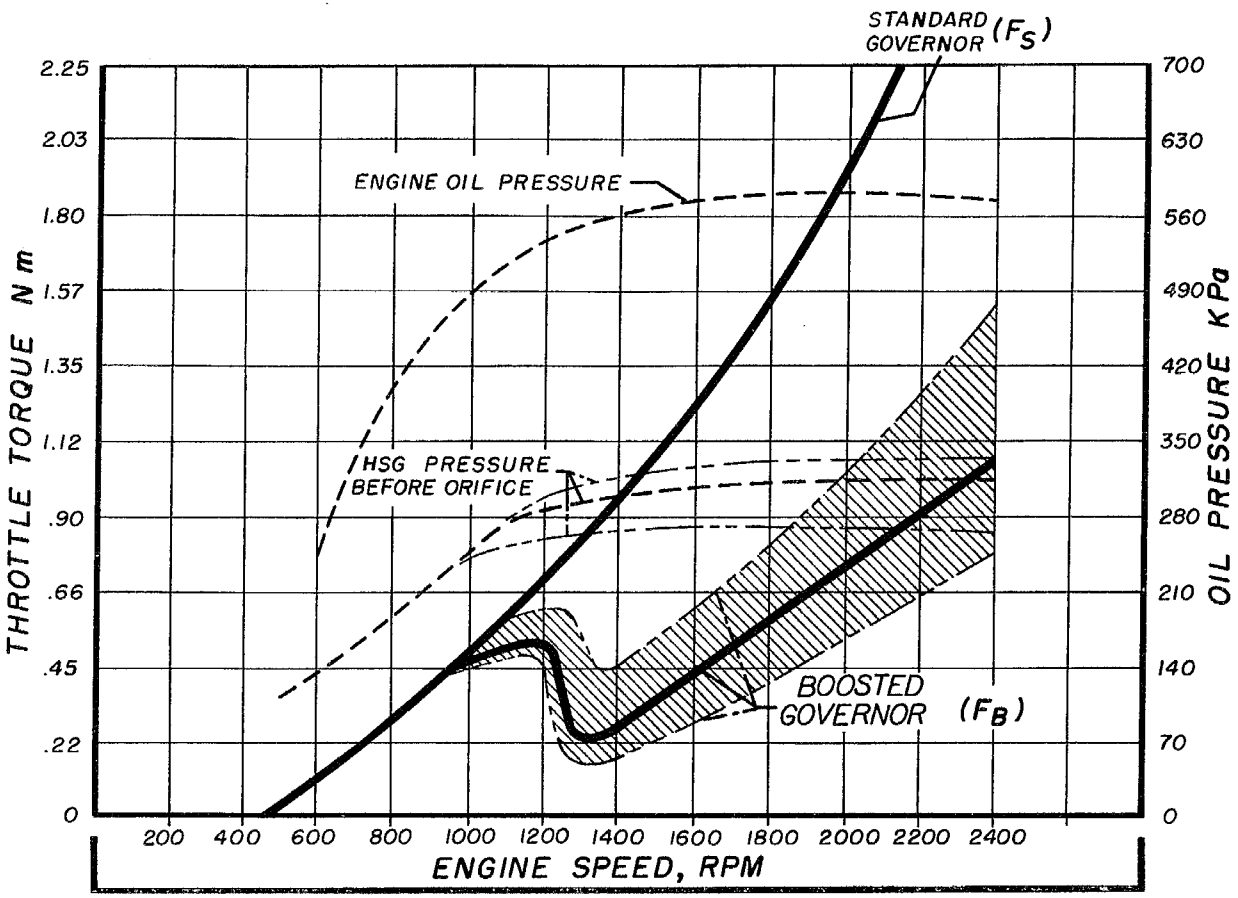
FIG. 6 graphically depicts throttle torque and oil pressure curves.

Thus, such boost force will be additive to the force applied to cylinder 46 by operator control means 14 with the latter force being depicted by the vertical distance between the "Standard Governor" (depicting the opposing force of governor spring 42) and "Boosted Governor" curves in FIG. 6. Booster means 15 thus automatically aids the operator in his application of pedal effort to change and maintain the setting of governor means 13 at higher engine speeds. For example, in FIG. 6 it can be seen that when the engine is running at 2000 rpm, the throttle shaft torque of approximately 1.93 N·m must be overcome by pedal effort without the use of booster means 15. However, the addition of booster means 15 to the system reduces such pedal effort to approximately 1.12 N·m.

It should be noted in FIG. 2 that a snap ring 56, mounted on a lower end of column 40, provides a stop means 57 for setting the maximum downward movement of cylinder 46 relative to column 40.

Figure 5:
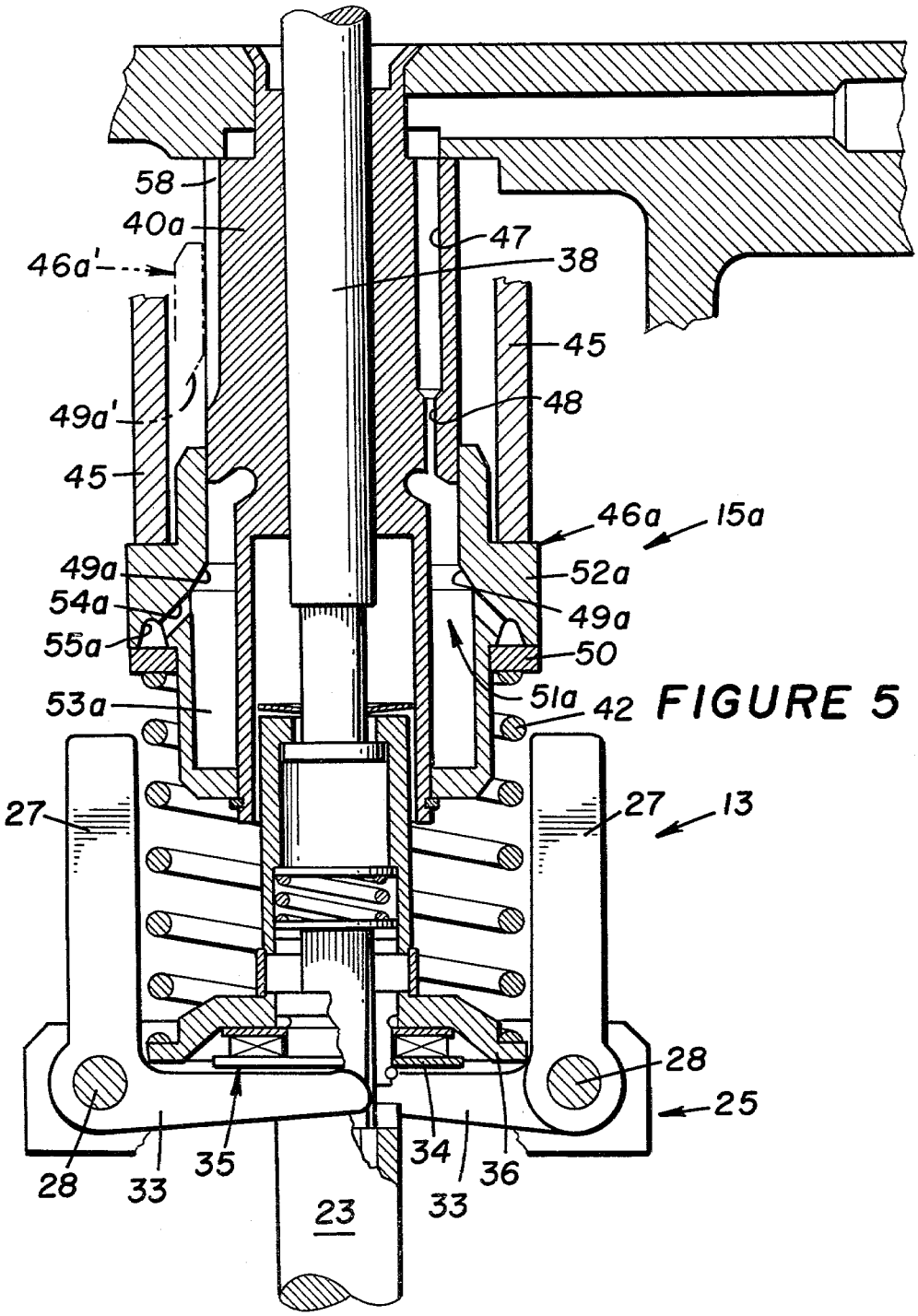
FIG. 5 is a view similar to FIG. 2, but illustrates a second booster apparatus embodiment of the present invention shown in a starting stage of engine operation.

FIG. 5 illustrates a second booster means embodiment 15*a* of the present invention wherein corresponding structures are depicted by identical numerals, but wherein numerals depicting modified constructions are accompanied by an "a." Booster means 15*a* comprises a cylinder 46*a* slidably mounted on a slightly modified column 40*a* for upward movement from its extreme downward or engine startup position illustrated in FIG. 5. In this position of cylinder 46*a*, engine oil may be communicated to an actuating chamber 53*a*, defined by column 40*a* and cylinder 46*a*, via passage 47 and orifice 48. Upon initial running or low idling of the engine, lever 45 is positioned to raise cylinder 46*a* to an extreme upward position 46*a'*. Chamber 53*a* will be thus vented to dump oil into the confines of housng 11, via vent means comprising a shoulder 49*a* formed on cylinder 46*a* and one or more slots 58 formed on column 40*a*. This initial dumping phase of operation is depicted between approximately 500 rpm and 1300 rpm on the "Boosted Governor" curve in FIG. 6.

Upon depression of the accelerator pedal by the operator to actuate operator control means 14 (FIG. 1), arms 45 of the governor control lever will move cylinder 46*a* down towards its FIG. 5 position to thus isolate chamber 53*a* from slot 58. Booster means 15*a* and a control means 51*a* thereof will thereafter function substantially similar to booster means 15 and control means 51 of the FIGS. 1 and 2 embodiment to maintain the oil pressure and control means 51 in chamber 53*a* substantially constant under control of orifice 48 and a valve ring 50*a*. Valve ring 50*a* normally engages a seat defined on an underside of a flange 52*a* of cylinder 46*a*, under the biasing force of governor spring 42. During operation, oil pressure is communicated to valve ring 50*a* via a plurality of ports 54*a* (one shown) and an annular groove 55*a*, both defined in cylinder 46*a*. Thus, should the oil pressure in chamber 53*a* exceed a predetermined level, valve ring 50*a* will unseat to dump-out such excess pressure.

Industrial Applicability

The above-described booster means 15 and 15*a* are particularly useful in association with the fuel control system of an internal combustion engine, such as a diesel engine typically run at rated speeds of from 1200 to 2400 rpm. It will be understood by those skilled in the arts relating hereto that such booster means are equally adapted for applications whereby a boosting force is desired to supplement an input force for controlling movement of a member which has an opposing force applied thereto.

Referring to FIGS. 1–4, when the engine is at rest and not running, governor spring 42 will expand to pivot flyweights 27 to their inactived and upright positions illustrated in FIG. 1. Upon startup and idling of the engine between 650 rpm and 1200 rpm, for example, flyweights 27 will pivot to the positions shown in FIG. 2 to control the engine speed by raising riser shaft 23 and attached shaft 19 to pivot bellcrank 16 clockwise in FIG. 1. The standard linkage system connecting bellcrank 16 with the fuel injection fuel pumps of the engine will thus meter the desired quantity of fuel to the cylinders of the engine during idling thereof.

Simultaneously therewith, arms 33 of flyweights 27 will, through spring 42, maintain cylinder 46 in an upward position located by lever 43, illustrated in FIG. 1, whereby booster means 15 is deactivated by permitting any engine oilcommunicated thereto via passage 47 and orifice 48 to be dumped within the interior of housing 11. This desired deactivation of booster means 15 will ensure stability of the system at low idle and constant rpm with either hot or cold oil. This condition of engine operation is reflected in FIG. 6 approximately between the 500 to 1300 rpm portion of the "Boosted Governor" curve.

As further shown in FIG. 6, it can be seen that without the aid of booster means 15 that the pedal effort required to overcome the opposing force of governor spring 42, as reflected by the "Standard Governor" throttle torque curve, increases sharply as engine speed increases. However, with the utilization of booster means 15, depression of the accelerator pedal under a first or operator imposed force will further function to condition the booster means for applying a second, additive force to oppose the opposing force of governor spring 42. As described above, upon depression of the accelerator pedal by the operator, arms 45 of governor control lever 43 will move cylinder 46 downwardly to cover shoulders 49 whereby an oil pressure build-up will occur in booster actuating chamber 53. Such oil pressure is also communicated to valve ring 50, via ports 54 and groove 55. As further shown in FIG. 6, booster means 15 is predesigned to allow oil pressure communicated to groove 55 to apply an opening force $F_V$ in opposition to a force $F_S$ of governor spring 42 whereby oil in chamber 53 is dumped past valve ring 50 in an amount substantially equal to the flow of oil through orifice 48 and to chamber 53.

The effective area of cylinder 46 is subjected to a booster force $F_B$ which is additive to operator input force $F_L$ to counteract the opposing force $F_S$ of governor spring 42. The effective area of cylinder 46 is precalculated and formed to assist the operator by reducing throttle pedal effort at higher speeds, as reflected by the general linear increase of the "Boosted Governor" curve in FIG. 6 upon increase of engine speed over 1300 rpm. For example, at 2,000 rpm pedal effort would require a throttle torque approximating 1.93 N·m without the aid of booster means 15. However, the pressurization of actuating chamber 53 to simultaneously apply a boost force $F_B$ of approximately 0.78 N·m reduces pedal effort approximately forty-on percent. Thus, the operator is enabled to balance force $F_S$ of governor spring 42 with minimal effort.

It should be further noted in FIG. 6 that the "Engine Pressure" (oil) curve rises upon starting of the engine and generally levels-off when engine speed exceeds 1200 rpm. Likewise, the "HSG Pressure Before Orifice" curve indicates that the oil pressure in passage 47, on the downstream side of orifice 48, levels-off at approximately 315 KPa when engine speed exceeds 1200 rpm. This relatively stable level of oil pressure can be utilized to properly size orifice 48 for effective operation of booster means 13.

Considering forces $F_L$, $F_B$, and $F_S$ in the context of a free body diagram, the sum of such forces equals zero to achieve static equilibrium. Therefore, it can be further seen that $$F_L+F_B=F_S$$

Furthermore, the summation of forces $F_V$ on valve ring 50 must equal zero and, therefore:

$F_V=P_G\times A_V$; wherein $P_G$=oil pressure in groove 55, and $A_V$=effective areas of valve ring 50

In addition, the summation of forces acting on cylinder 46 must equal zero and, therefore:

$$F_B+F_L=F_V$$

It can thus be seen that the primary purpose of booster means 15 is to reduce force $F_L$ whereby:

$$F_L=F_V-F_B=F_V-(P_G\times A_B)$$
$$=F_V-(F_V/A_V\times A_B)$$
$$=F_S-(F_S/A_V\times A_B)$$

$=F_S-(F_S \times A_B/A_V)$ $=F_S \times (1-A_B/A_V)$; wherein $A_B$ is the effective area of cylinder 46 for applying force $F_B$ thereto.

It should be understood that the effective area of grooves 55 and 55*a* could be increased or decreased in respect to chambers 53 and 53*a*, respectively, to provide various ratios effecting corresponding changes in boost force $F_B$. The shaded area in FIG. 6 depicts such variations of boost forces which provide for the pre-selection of a boost force to effect a predetermined ratio in respect to the input force of the operator to aid operator comfort.

The FIG. 5 booster means embodiment 15*a* functions substantially similar to above-described booster means 15. As described above, the primary difference between the two embodiments is that upon startup of the engine in FIG. 5, flyweights 27 will pivot outwardly to move cylinder 46*a* upwardly to, in turn, dump oil from chamber 53*a* to the interior of housing 11, via shoulder 49*a* and slot 58. This initial dumping of oil from chamber 53*a* is reflected by the "Boosted Governor" curve in FIG. 6, between approximately 500 and 1300 rpm of engine operation, i.e., low idle. When the operator depresses the accelerator pedal to further increase engine speed, the booster force curve will generally assume the operational characteristics shown in FIG. 6.

Other aspects, objects, and advantages of this invention can be obtained from a study of the drawings, the disclosure and the appended claims.

We claim:

1. In a fuel control system having fuel control means (12) for controlling supply of fuel to an engine, governor means (13) for automatically controlling supply of fuel to said engine by said fuel control means (12) in response to the speed of said engine, operator input means (14) for selectively applying a first force to said governor means (13) to oppose a counteracting force thereof, and booster means (15,15*a*) for applying a second force to said governor means (13), additive to said first force, to aid said operator input means (14) in controlling said governor means (13), the improvement comprising said booster means (15,15*a*) including an actuating chamber (53,53*a*), control means (51,51*a*) for continuously maintaining a predetermined fluid pressure in said actuating chamber (53,53*a*) in a predetermined ratio to said first force and when said operator input means (14) is moved to a predetermined position, and vent means (49,49*a*,58) for venting fluid pressure from said actuating chamber (53,53*a*) when the speed of said engine is in a first speed range and for closing when the speed of said engine exceeds said speed range.

2. The fuel control system of claim 1 wherein said control means (51,51*a*) includes orifice means (48) for communicating a predetermined fluid flow to said actuating chamber (53,53*a*).

3. The fuel control system of claim 2 wherein said control means (51,51*a*) further includes valve means (50') for venting fluid from said actuating chamber (53,53*a*) maintaining the fluid pressure therein in a predetermined ratio to said first force.

4. The fuel control system of claim 3 wherein said booster means (15,15*a*) further includes a cylinder (46,46*a*).

5. The fuel control system of claim 4 wherein said cylinder (46,46*a*) is reciprocally mounted on a column (40,40*a*) to define said actuating chamber (53,53*a*) therewith, said operator input means (14) engaging said cylinder (46,46*a*) for moving it in a first direction and said governor means (13) including spring means (42) for urging said cylinder (46,46*a*) in a second direction opposite to said first direction.

6. The fuel control system of claim 4 wherein said valve means (50') includes a ring (50) normally engaging a seat defined on said cylinder (46,46*a*) and further including means (54,55,54*a*,55*a*) for communicating fluid pressure from said actuating chamber (53,53*a*) to said ring (50).

7. The fuel control system of claim 6 wherein said governor means (13) includes spring means (42) for engaging said ring (50) for urging it towards said seat.

8. The fuel control system of claim 4 further including stop means (57) for limiting axial movement of said cylinder (46,46*a*).

9. The fuel control system of claim 1 wherein said booster means (15,15*a*) includes a cylinder (46,46*a*) reciprocally mounted on a column (40,40*a*) and wherein said vent means (49,49*a*,58) is defined between said cylinder (46,46*a*) and said column (40,40*a*) when said cylinder (46,46*a*) is moved to a predetermined position on said column (40,40*a*).

10. The fuel control system of claim 9 wherein said vent means (49) includes at least one angled shoulder formed externally on said column (40).

11. The fuel control system of claim 9 wherein said vent means (49*a*,58) includes at least one shoulder (49*a*) formed internally on said cylinder (46*a*) and at least one slot (58) formed externally on said column (40*a*).

12. The fuel control system of claim 1 wherein the second force applied to said governor means (13) by said booster means (15,15*a*) is at least approximately within the range of "Booster Governor" curves shown in FIG. 6.

13. A booster apparatus having a control member (23), first means (13) for applying a first force to said control member (23) to move it in a first direction, second means (14) for applying a second force to said control member (23) in opposition to said first force, and third means (15,15*a*) for applying a third force to said control member (23) additive to said second force to assist said second means (14) in urging said control member (23) in a second direction opposite to said first direction, the improvement comprising said third means (15,15*a*) including a reciprocal cylinder (46,46*a*) positioned to be subjected to said first, second, and third forces, an actuating chamber (53,53*a*), control means (51,51*a*) for continuously and automatically maintaining a predetermined and an at least substantially constant fluid pressure in said actuating chamber (53,53*a*) when said second means (14) is moved to a predetermined position, and means (49,49*a*,58) for automatically deactivating said third means (15,15*a*) in response to said first means (13) being in a selected speed range.

14. The booster apparatus of claim 13 wherein said control means (51,51*a*) includes orifice means (48) for communicating a predetermined fluid flow to said actuating chamber (53,53*a*).

15. The booster apparatus of claim 14 wherein said control means (51,51*a*) further includes valve means (50') for venting fluid from said actuating chamber (53,53*a*) to maintain the fluid pressure therein at least substantially constant.

16. The booster apparatus of claim 13 wherein said cylinder (46,46*a*) is reciprocally mounted on a column (40,40*a*) to define said actuating chamber (53,53*a*) therewith, said second means (14) engaging said cylinder (46,46*a*) to move it in said second direction and said first means (13) including spring means (42) for urging said cylinder (46,46*a*) in said first direction.

17. The booster apparatus of claim 13 wherein said valve means (50') includes a ring (50) normally engaging a seat defined on said cylinder (46,46*a*) and further including means (54,55,54*a*,55*a*) for communicating fluid pressure from said actuating chamber (53,53*a*) to said ring (50).

18. The booster apparatus of claim 17 wherein said first means (13) includes spring means (42) for engaging said ring (50) to urge it towards said seat.

19. The booster apparatus of claim 13 further including stop means (57) for limiting reciprocal movement of said cylinder (46,46*a*).

20. The booster apparatus of claim 13 further including vent means (49,49*a*,58) for opening to vent fluid pressure from said actuating chamber (53,53*a*).

21. The booster apparatus of claim 20 wherein said cylinder (46,46*a*) is reciprocally mounted on a column (40,40*a*) and wherein said vent means (49,49*a*,58) is defined between said cylinder (46,46*a*) and said column (40,40*a*) when said cylinder (46,46*a*) is moved to a predetermined position on said column (40,40*a*).

22. The booster apparatus of claim 21 wherein said vent means (49) includes at least one angled shoulder formed externally on said column (40).

23. The booster apparatus of claim 21 wherein said vent means (49*a*,58) includes at least one shoulder (49*a*) formed internally on said piston (46*a*) and at least one slot (58) formed externally on said column (40*a*).

24. The booster apparatus of claim 13 wherein the third force applied to said first means (13) by said third means (15,15*a*) at least generally conforms to the "Booster Governor" curve in FIG. 6.

25. In a fuel control system having fuel control means (12) for controlling supply of fuel to an engine governor means (13) for automatically controlling supply of fuel to said engine by said fuel control means (12) in response to the speed of said engine, operator input means (14) for selectively applying a first force to said governor means (13) to oppose a counteracting force thereof, and booster means (15,15*a*) for applying a second force to said governor means (13), additive to said first force, to aid said operator input means (14) in controlling said governor means (13), the improvement comprising said booster means (15,15*a*) including reciprocal cylinder means (46,46*a*) for being directly subjected to said first, second, and counteracting forces, valve means (51) for continuously and automatically controlling said second force in a predetermined ratio to said first force, a fluid chamber (53,53*a*) defined in said cylinder means (46,46*a*) and terminating at an annular groove (55), said valve means (51,51*a*) including a ring (50,50*a*) mounted externally on said cylinder (46,46*a*) and axially opposed to said groove (55), and spring means (42) for engaging said ring (50,50*a*) to urge it towards a closed position over said groove (55).

26. A booster apparatus having a control member (23), first means (13) for applying a first force to said control member (23) to move it in a first direction, second means (14) for applying a second force to said control member (23) in opposition to said first force, and third means (15,15*a*) for applying a third force to said control member (23) additive to said second force to assist said second means (14) in urging said control member (23) in a second direction opposite to said first direction, the improvement comprising said third means (15,15*a*) including an actuating chamber (53,53*a*) control means (51,51*a*) for continuously maintaining a predetermined and an at least substantially constant fluid pressure in said actuating chamber (53,53*a*) when said second means (14) is moved to a predetermined position, and a cylinder (46,46*a*) reciprocally mounted on a column (40,40*a*), and vent means (49,49*a*,58) for opening to vent fluid pressure from said actuating chamber (53,53*a*), said vent means (49,49*a*,58) defined between said cylinder (46,46*a*) and said column (40,40*a*) when said cylinder (46,46*a*) is moved to a predetermined position on said column (40,40*a*).

* * * * *